US011854735B2

(12) United States Patent
Su et al.

(10) Patent No.: US 11,854,735 B2
(45) Date of Patent: Dec. 26, 2023

(54) WINDING STRUCTURE FOR INDUCTOR AND METHOD FOR MANUFACTURING THE SAME, WINDING INDUCTOR AND METHOD FOR MANUFACTURING THE SAME

(71) Applicant: Shenzhen Sunlord Electronics Co., Ltd., Guangdong (CN)

(72) Inventors: Qiang Su, Guangdong (CN); Youyun Li, Guangdong (CN); Shengcheng Xia, Guangdong (CN); Xinshu Yu, Guangdong (CN)

(73) Assignee: Shenzhen Sunlord Electronics Co., Ltd., Shenzhen (CN)

( * ) Notice: Subject to any disclaimer, the term of this patent is extended or adjusted under 35 U.S.C. 154(b) by 487 days.

(21) Appl. No.: 17/200,887

(22) Filed: Mar. 14, 2021

(65) Prior Publication Data

US 2022/0157515 A1 May 19, 2022

Related U.S. Application Data

(63) Continuation of application No. PCT/CN2020/129321, filed on Nov. 17, 2020.

(51) Int. Cl.
*H01F 27/29* (2006.01)
*H01F 27/30* (2006.01)
(Continued)

(52) U.S. Cl.
CPC ..... *H01F 27/306* (2013.01); *H01F 27/24* (2013.01); *H01F 27/2823* (2013.01); *H01F 27/29* (2013.01); *H01F 41/061* (2016.01)

(58) Field of Classification Search
CPC .... H01F 27/306; H01F 27/24; H01F 27/2823; H01F 41/061; H01F 27/2852;
(Continued)

(56) References Cited

U.S. PATENT DOCUMENTS 6,292,081 B1 9/2001 Armfield
10,210,973 B2 * 2/2019 Shinohara ..... H01F 27/255
(Continued)

FOREIGN PATENT DOCUMENTS

CN 2157582 Y 2/1994
CN 202632936 U 12/2012
(Continued)

*Primary Examiner* — Tuyen T Nguyen
(74) *Attorney, Agent, or Firm* — Winston Hsu

(57) ABSTRACT

A winding structure includes a coil having a wire wrap and two wire tails, and a magnetic core having a center column, a flange, four wire-hanging parts and two bosses; the center column is connected at a top surface of the flange, the first boss is disposed in the middle of a first side of the flange, and the second boss is symmetrical to the first boss; transition surfaces of wire-hanging parts to a bottom surface of the flange are chamfered surfaces; first to fourth sections of the first wire tail are sequentially attached to the first wire-hanging part and the first chamfered surface, the bottom surface of the flange, the third chamfered surface, the third wire-hanging part, and the top surface of the flange; first to fourth sections of the second wire tail are symmetrical to first to fourth sections of the first wire tail, respectively.

10 Claims, 4 Drawing Sheets

(51) Int. Cl.
*H01F 41/061* (2016.01)
*H01F 27/24* (2006.01)
*H01F 27/28* (2006.01)

(58) Field of Classification Search
CPC .. H01F 2017/046; H01F 17/045; H01F 27/29; H01F 27/292; H01F 2027/295; H01F 336/192; H01F 336/221
See application file for complete search history.

(56) References Cited

U.S. PATENT DOCUMENTS

| | | | | |
|---|---|---|---|---|
| 10,867,744 | B2 * | 12/2020 | Shinohara | H01F 27/306 |
| 2009/0002112 | A1 * | 1/2009 | Atsushi | H01F 27/022 336/83 |
| 2014/0097929 | A1 * | 4/2014 | Nakada | H01F 27/00 336/221 |
| 2021/0225580 | A1 * | 7/2021 | Iwata | H01F 27/2823 |

FOREIGN PATENT DOCUMENTS

| | | | |
|---|---|---|---|
| CN | 205159028 | U | 4/2016 |
| KR | 10-1177532 | B1 | 8/2012 |

* cited by examiner

WINDING STRUCTURE FOR INDUCTOR AND METHOD FOR MANUFACTURING THE SAME, WINDING INDUCTOR AND METHOD FOR MANUFACTURING THE SAME

CROSS REFERENCE TO RELATED APPLICATIONS

This application is a continuation application of PCT/CN2020/129321, filed on Nov. 17, 2020. The contents of PCT/CN2020/129321 are all hereby incorporated by reference.

BACKGROUND OF THE INVENTION

1. Field of the Invention

The application relates to components of an electronic device, more particularly, to a winding structure for an inductor and a method for manufacturing the same, and a winding inductor and a method for manufacturing the same.

2. Description of the Prior Art

As a basic electronic device, inductors have various types and are now facing increasing demands in the information industry, along with stricter requirements on electrical and mechanical properties of the inductor, and thus a stable structure corresponding thereto is desirable as a foundation; as a result, it's one of the subjects in the research conducted by those skilled in the art to optimize the structure thereof, however, a winding for an inductor with high reliability and stable structure has not been seen in the prior art.

SUMMARY OF THE INVENTION

To overcome the defects of the prior art, this application provides a winding structure for an inductor and a method for manufacturing the same, and a winding inductor and a method for manufacturing the same.

The application employs the following technical solution.

A winding structure for an inductor, including: a magnetic core and a coil; wherein the magnetic core comprises a center column, a flange, a first wire-hanging part, a second wire-hanging part, a third wire-hanging part, a fourth wire-hanging part, a first boss and a second boss, wherein the center column is connected at a top surface of the flange and extends upwards, the first boss is disposed in the middle of a first side of the flange and extends outwards, the second boss is disposed in the middle of a second side of the flange and extends outwards, and the first side is opposite the second side; two side surfaces of the first side of the flange on two sides of the first boss are used as the first wire-hanging part and the second wire-hanging part, respectively, and two side surfaces of the second side of the flange on two sides of the second boss are used as the third wire-hanging part and the fourth wire-hanging part, respectively; a transition surface of the first wire-hanging part to a bottom surface of the flange is a first chamfered surface, a transition surface of the second wire-hanging part to a bottom surface of the flange is a second chamfered surface, a transition surface of the third wire-hanging part to a bottom surface of the flange is a third chamfered surface, and a transition surface of the fourth wire-hanging part to a bottom surface of the flange is a fourth chamfered surface; the coil comprises a wire wrap, a first wire tail and a second wire tail extending from two ends of the wire wrap, respectively, and the wire wrap is sleeved on the center column; a first section of the first wire tail is attached to the first wire-hanging part and the first chamfered surface, a second section of the first wire tail is attached to the bottom surface of the flange, a third section of the first wire tail is attached to the third wire-hanging part and the third chamfered surface, and a fourth section of the first wire tail is buckled to the top surface of the flange; a first section of the second wire tail is attached to the second wire-hanging part and the second chamfered surface, a second section of the second wire tail is attached to the bottom surface of the flange, a third section of the second wire tail is attached to the fourth wire-hanging part and the fourth chamfered surface, and a fourth section of the second wire tail is buckled to the top surface of the flange; the second section of the first wire tail and the second section of the second wire tail are parallel.

Preferably, each of the first wire-hanging part, the second wire-hanging part, the third wire-hanging part and the fourth wire-hanging part is a vertical plane, each of the first chamfered surface, the second chamfered surface, the third chamfered surface and the fourth chamfered surface is an inclined plane, the vertical plane and the inclined plane forma convex V-shape, the vertical plane is perpendicular to the top surface of the flange, and the inclined plane is inclined from a bottom edge of the vertical plane to the bottom surface of the flange.

Preferably, an angle of inclination of the inclined plane is between 30° and 45°.

Preferably, each of a gap between the second section of the first tail and the bottom surface of the flange and a gap between the second section of the second tail and the bottom surface of the flange is 0-0.1 mm; the wire tails have a wire thickness such that the wire tails attached to the wire-hanging parts do not reach beyond outer edges of the first boss and the second boss; a length of each wire-hanging part is greater than a width of each of the two wire tails and a length of each chamfered surface is greater than the width of each of the two wire tails.

Preferably, the magnetic core is an integrally formed structure.

A winding inductor having the above-mentioned winding structure.

A method for manufacturing the winding structure, including the steps of:

(1) compressing the wire wrap sleeved on the center column;

(2) starting from the top surface of the flange, bending the first wire tail downwards for the first time to enable the first section of the first wire tail to be attached to the first wire-hanging part and the first chamfered surface, bending the first wire tail rightwards for the second time to enable the second section of the first wire tail to be attached to the bottom surface of the flange, and then bending the first wire tail upwards for the third time to enable the third section of the first wire tail to be attached to the third wire-hanging part and the third chamfered surface, finally, bending leftwards for the fourth time to enable the fourth section of the first wire tail to be buckled on the top surface of the flange;

(3) starting from the top surface of the flange, bending the second tail downwards for the first time to enable the first section of the second tail to be attached to the second wire-hanging part and the second chamfered surface, bending the second tail rightwards for the second time to enable the second section of the second tail to be attached to the bottom surface of the flange, and then bending upwards for the third time to enable the third section of the second tail to be attached to the fourth wire-hanging part and the fourth chamfered surface, finally, bending leftwards for the fourth time to enable the fourth section of the second tail to be buckled on the top surface of the flange.

Preferably, the method further includes the step of cutting the first wire tail and the second wire tail, so that each of the fourth sections of the two wire tails buckled on the top surface of the flange after the fourth bending keeps a safe distance from and avoids interference with the wire wrap, wherein the cutting is performed before the first bending, after the first bending, after the second bending or after the third bending.

Preferably, each bending angle in steps (1) and (2) is 80° to 90°.

Preferably, metallizing or pre-metallizing portions of the first wire tail and the second wire tail on the bottom surface of the flange, respectively.

A method for manufacturing a winding inductor, wherein the winding structure manufactured by the method for manufacturing the winding structure is formed into the winding inductor.

This application is advantageous in that the two wire tails of the winding structure are buckled on the top surface of the flange after being bent for four times, respectively, and the transition surface between the wire-hanging part on the side surface of the flange and the bottom surface of the flange is a chamfered surface, so that the gap between each of the second sections of the two wire tails and the bottom surface of the flange can be reduced when bending for the second time, as a result, the winding structure formed thereby is stable, and the inductor formed thereby is stable in the dimension. Moreover, the wire wrap and the wire tails are attached tightly to the magnetic core, featuring good consistency in the winding, and in turn, the inductor formed thereby surely has an optimized electrical consistency, avoiding the risk of open circuit and short circuit.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
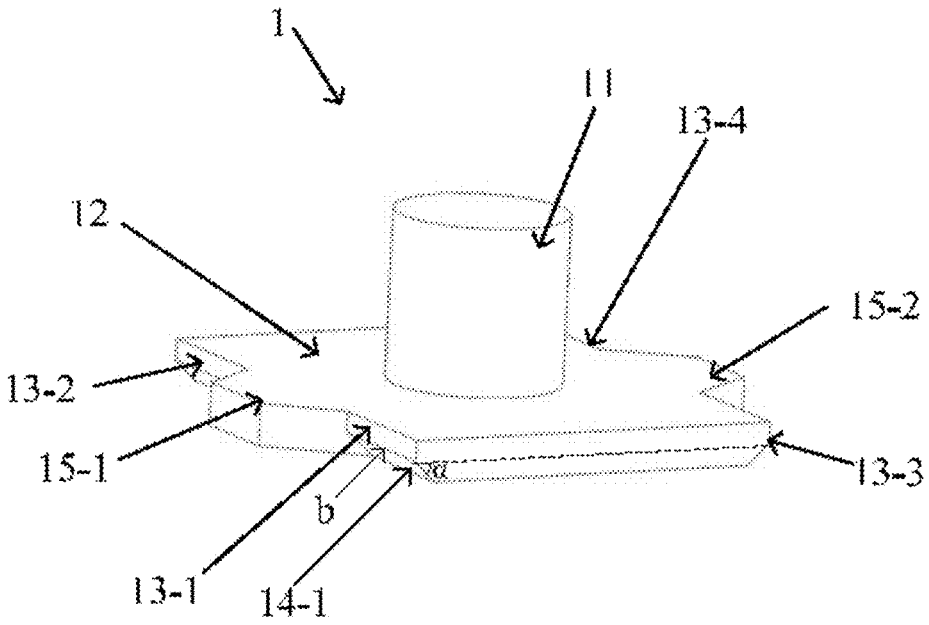
FIG. 1 is a schematic view showing a structure of a magnetic core 1 in an embodiment of this application.

This application will now be described in further detail with reference to the accompanying drawings and examples. It should be understood that the specific embodiments described herein are merely illustrative of the application and are not intended to be limiting.

It should be noted that the terms"left", "right", "up", "down", "top", "bottom", and the like herein are merely relative concepts to indicate positions and orientations with reference to the orientations shown in the drawings and should not be taken as limiting.

Although this application uses the terms "first", "second", "third" and the like to describe various components, it should be understood that these components should not be limited by such terms. Such terms are used solely to distinguish one element from another or to facilitate the description and understanding thereof, and are not intended to indicate a predetermined sequence of the described elements, nor are they intended to indicate the priority of one element to another, or an order of a manufacturing process. Therefore, the first component discussed below may also be represented as a second component or the like without departing from the scope of specific embodiments of this application.

Herein, where a "wire-hanging part(s)" is referred to and not defined by terms like "first", "second", "third" or "fourth", the "wire-hanging part(s)" refers to each of the first wire-hanging part, the second wire-hanging part, the third wire-hanging part and the fourth wire-hanging part; where a "chamfered surface(s)" is referred to and not defined by terms like "first", "second", "third" or "fourth", the "chamfered surface(s)" refers to each of the first chamfered surface, the second chamfered surface, the third chamfered surface and the fourth chamfered surface; where a "wire tail(s)" is referred to and is not defined by terms like "first" or "second", the "wire tail(s)" refers to each of the first tail and the second tail.

As shown in FIGS. 1 to 10, in one embodiment, a winding structure for an inductor includes a magnetic core 1 and a coil 2, the magnetic core 1 including a center column 11, a flange 12 (also referred to as a swinging flange), a first wire-hanging part 13-1, a second wire-hanging part 13-2, a third wire-hanging part 13-3, a fourth wire-hanging part 13-4, a first boss 15-1, and a second boss 15-2. The center column 11 is connected at a top surface of the flange 12 and extends upwards, the first boss 15-1 is disposed in the middle of a first side of the flange 12 and extends outwards, the second boss 15-2 is disposed in the middle of a second side of the flange 12 and extends outwards, and the first side is opposite the second side. Side surfaces of the first side of the flange 12 on two sides of the first boss 15-1 are used as a first wire-hanging part 13-1 and a second wire-hanging part 13-2, respectively, and side surfaces of the second side of the flange on two sides of the second boss 15-2 are used as a third wire-hanging part 13-3 and a fourth wire-hanging part 13-4, respectively. That is, the first wire-hanging part 13-1 and the second wire-hanging part 13-2 are symmetrically positioned on two sides of the first boss 15-1, and the third wire-hanging part 13-3 and the fourth wire-hanging part 13-4 are also symmetrically positioned on two sides of the second boss 15-2; transition surfaces of the first to fourth wire-hanging parts to a bottom surface of the flange are first to fourth chamfered surfaces, respectively, that is, a transition surface of the first wire-hanging part to a bottom surface of the flange is a first chamfered surface, a transition surface of the second wire-hanging part to a bottom surface of the flange is a second chamfered surface, a transition surface of the third wire-hanging part to a bottom surface of the flange is a third chamfered surface, and a transition surface of the fourth wire-hanging part to a bottom surface of the flange is a fourth chamfered surface. The coil 2 includes a wire wrap 21, a first wire tail 22 and a second wire 23 tail extending from two ends of the wire wrap 21, respectively, and the wire wrap 21 is sleeved on the center column 11; a first section of the first wire tail 22 is attached to the first wire-hanging part and a first chamfered surface, a second section of the first wire tail 22 is attached to the bottom surface of the flange, a third section of the first wire tail 22 is attached to the third wire-hanging part and the third chamfered surface, and a fourth section of the first wire tail 22 is buckled to the top surface of the flange; a first section of the second wire tail is attached to the second wire-hanging part and the second chamfered surface, symmetrical to the first section of the first wire tail, a second section is attached to the bottom surface of the flange, parallel to the second section of the first wire tail, a third section of the second wire tail is attached to the fourth wire-hanging part and the fourth chamfered surface, symmetrical to the fourth section of the first wire tail, and a fourth section of the second wire tail is buckled to the top surface of the flange, symmetrical and parallel to the fourth section of the first wire tail.

Figure 2:
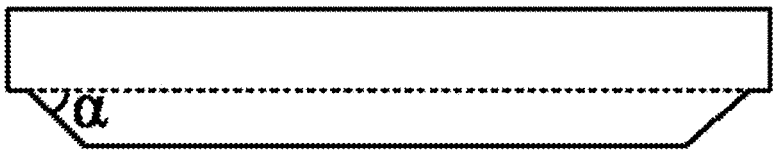
FIG. 2 is a schematic side view showing a structure of a flange of the magnetic core 1 in the embodiment of this application allowable during an actual forming process.
Figure 3:
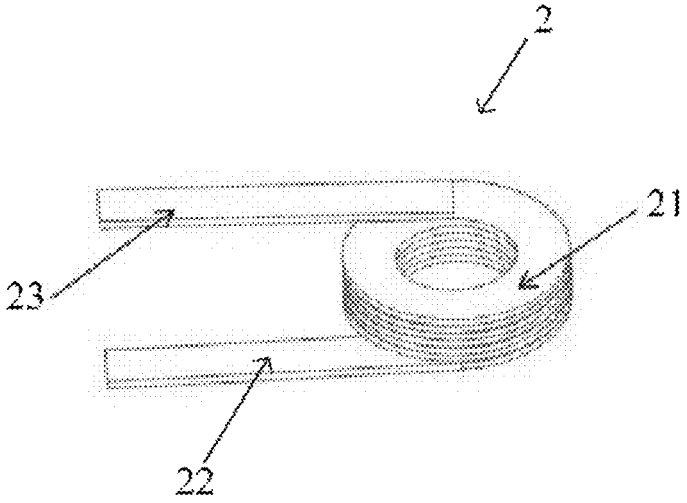
FIG. 3 is a schematic view showing a structure of a coil 2 in an embodiment of this application.
Figure 9:
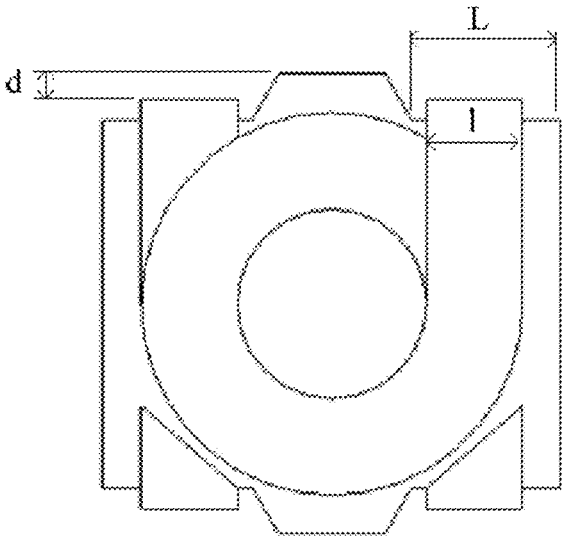
FIG. 9 is a schematic view showing a single winding structure in an embodiment of this application.

The first to fourth chamfered surfaces are arc curved surfaces or inclined planes, and preferably, as shown in FIG. 1, the first to fourth wire-hanging parts have the same structure as follows: the wire-hanging part is a vertical plane; the first to fourth chamfered surfaces have the same structure as follows: the chamfered surface is an inclined plane. The vertical plane and the inclined plane form a convex V-shape, the vertical plane is perpendicular to the top surface of the flange, the inclined plane is inclined from a bottom edge of the vertical plane to the bottom surface of the flange, and an angle of inclination of the inclined plane is between 30° and 45°. In the example of FIG. 1 (only the first chamfered surface 14-1 is shown in FIG. 1), the first wire-hanging part 13-1 is a vertical plane perpendicular to the top surface of the flange 12, the lengths of the first wire-hanging part 13-1 and the first chamfered surface 14-1 are equal and both greater than the widths of the two wire tails (as shown in FIG. 9, the length L is greater than the width 1 of the wire tail), the inclined plane is inclined from the bottom edge of the vertical plane to the bottom surface of the flange (i.e., as shown in FIG. 1, a top edge b of the first chamfered surface 14-1 is the same edge as a bottom edge b of the first wire-hanging part 13-1). However, in the actual forming process, as shown in FIG. 2, a certain gap (preferably, a pitch of not more than 0.1 mm) is allowed between the top edge of the first chamfered surface 14-1 and the bottom edge of the first wire-hanging part 13-1), and the angle α of inclination of the first chamfered surface 14-1 is between 30° and 45°.

The magnetic core is of an integrally formed structure and can be made of different materials, such as ferrite, FeNi and the like. The center column can be racetrack-shaped, circular, spiral and the like. The top surfaces of the first boss and the second boss are flush with the top surface of the flange, and the bottom surfaces of the first boss and the second boss are flush with the bottom surface of the flange. As shown in the example of FIG. 1, the first boss and the second boss are both trapezoid structures, but not limited thereto. The wire tail has a wire thickness such that the wire tail attached to the wire-hanging part does not reach beyond outer edges of the first boss and the second boss, that is, as shown in FIG. 9, d is greater than 0. The magnetic core may be a T-shaped or otherwise shaped cores, in the example herein the magnetic core is T-shaped.

The coil is a hollow coil, the hollow portion is sleeved on the center column, the wire wrap does not reach beyond the flange, and the coil can be formed by winding round wires or flat wires. The coil can be formed either by sleeving on the center column after independent processing and forming, or by directly winding on the center column, and the winding methods include opposite winding, vertical winding, lap winding and the like.

An end of the fourth section of the first tail is at a safe distance from the wire wrap so that no interference occurs between the first tail and the wire wrap, and accordingly, an end of the fourth section of the second tail is at a safe distance from the wire wrap so that no interference occurs between the second tail and the wire wrap.

In the above-mentioned embodiment, the wire tail is buckled on the top surface of the flange after being bent for four times, and the chamfered surface, in combination with the fourth bending, reduces the gap between the second section of the wire tail after being bent for the second time and the bottom surface of the flange. In the winding structure formed thereby, the magnetic core and the coil are integrally formed, the wire tail is free from displacement and deformation, so that the parallelism of the electrode (i.e., the second section of the wire tail is metallized to serve as the electrode of the inductor), the coplanarity of the winding, and the height of the winding are ensured. The inductor formed thereby is stable in the dimension, moreover, the wire wrap and the wire tails are attached tightly to the magnetic core, featuring good consistency in the winding, and the inductor formed thereby surely has an optimized electrical consistency, avoiding the risk of open circuit and short circuit.

In some embodiments, the second section of the first wire tail and the second section of the second wire tail are metallized to serve as electrodes.

In some embodiments, each of a gap between the second section of the first tail and the bottom surface of the flange and a gap between the second section of the second tail and the bottom surface of the flange is 0-0.1 mm In some embodiments, a chamfer of each chamfered surface is matched with the wire thickness tail to ensure the flatness of the wire tail during the second bending, so that the second section of the wire tail is attached tightly to the bottom surface of the flange, and the gap between the second section of the wire tail and the bottom surface of the flange is ensured to be as small as possible, for example, if the wire thickness is less than 0.15 mm, a chamfer of C0.05 can be used, and if the wire thickness is between 0.15 mm and 2 mm, a chamfer of C0.1 may be used.

Figure 4:
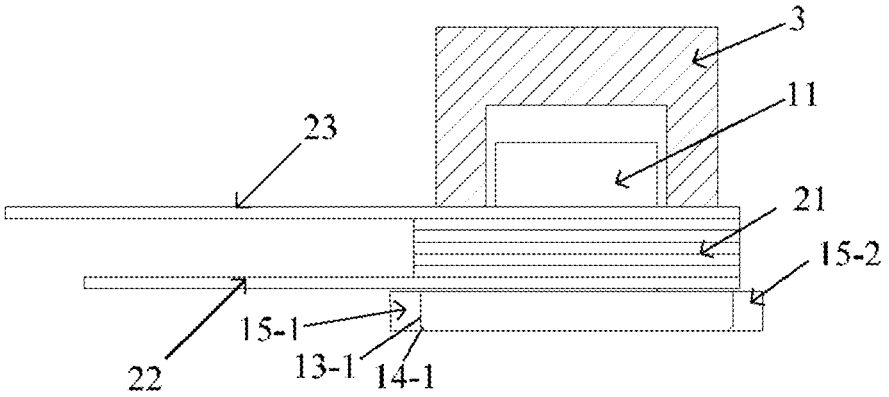
FIG. 4 is a schematic view showing assembled and compacted coil and magnetic core in an embodiment of this application.
Figure 5:
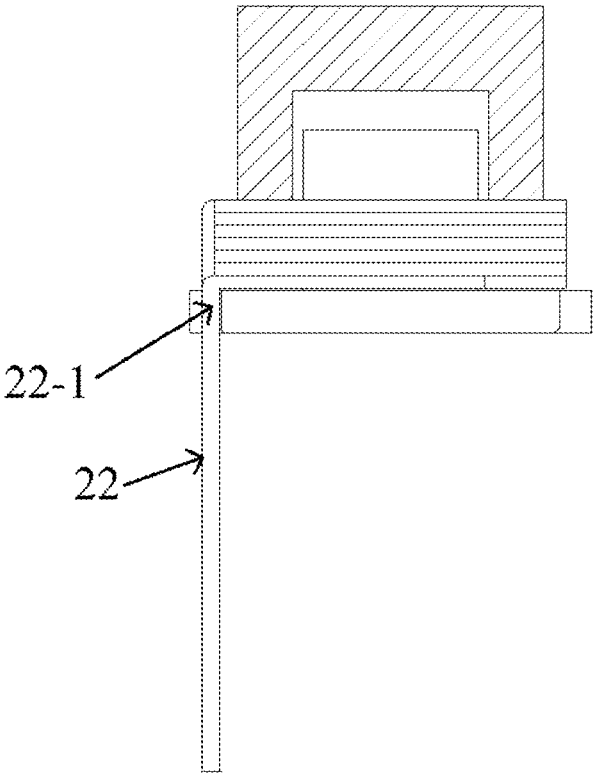
FIG. 5 is a schematic view showing a first tail 22 when bent for the first time according to an embodiment of this application.
Figure 6:
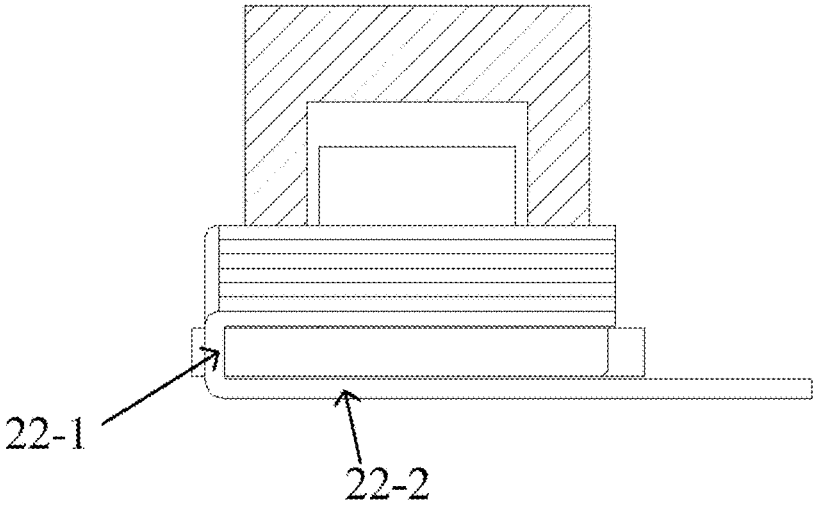
FIG. 6 is a schematic view showing a first tail 22 when bent for the second time according to an embodiment of this application.
Figure 7:
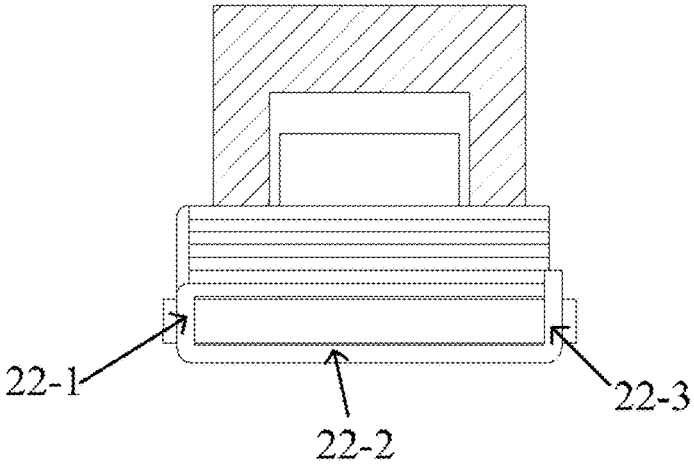
FIG. 7 is a schematic view showing a first tail 22 when bent for the third time according to an embodiment of this application.
Figure 8:
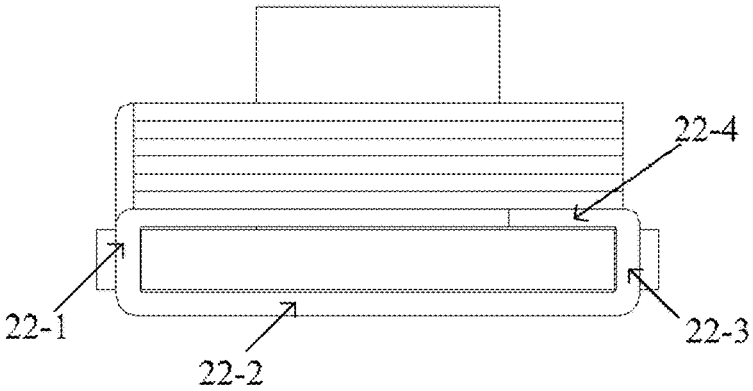
FIG. 8 is a schematic view showing a first tail 22 when bent for the fourth time according to an embodiment of this application.

The embodiment of this application also provides a method for manufacturing the winding structure, including the steps of:

(1) compressing the wire wrap sleeved on the center column, wherein as shown in FIG. 4, the center column can be sleeved with a prefabricated sleeve 3 so that the wire wrap is attached tightly to the top surface of the flange, the wire wrap is prevented from rebounding, and the prefabricated sleeve 3 compacts the wire wrap all the time in the subsequent winding and forming process;

(2) starting from the top surface of the flange 12, bending the first wire tail 22 downwards for the first time (as shown in FIG. 5) to enable the first section of the first wire tail to be attached to the first wire-hanging part and the first chamfered surface, bending the first wire tail rightwards for the second time to enable the second section of the first wire tail to be attached to the bottom surface of the flange (as shown in FIG. 6), and then bending the first wire tail upwards for the third time (as shown in FIG. 7) to enable the third section of the first wire tail to be attached to the third wire-hanging part and the third chamfered surface, finally, bending leftwards for the fourth time to enable the fourth section of the first wire tail to be buckled on the top surface of the flange (as shown in FIG. 8);

(3) starting from the top surface of the flange 12, bending the second tail 23 downwards for the first time to enable the first section of the second tail to be attached to the second wire-hanging part and the second chamfered surface, bending the second tail rightwards for the second time to enable the second section of the second tail to be attached to the bottom surface of the flange, and then bending upwards for the third time to enable the third section of the second tail to be attached to the fourth wire-hanging part and the fourth chamfered surface, finally, bending leftwards for the fourth time to enable the fourth section of the second tail to be buckled on the top surface of the flange.

Preferably, after the first bending, the first wire tail and the second wire tail can be guided into a positioning groove, for fixing the wire tail, of the equipment jig for bending treatment, so that a distance between the first wire tail and the second wire tail in the subsequent bending process (mainly in the second bending process) is fixed, and the stability in the dimension of the electrode is enhanced.

Herein, steps (2) and (3), without limitations on their sequence, can be performed simultaneously or separately regardless of priority, and the prefabricated sleeve 3 is removed after the two wire tails are completely bent.

Taking the first tail 22 as an example, after four times of bending, four sections are formed, namely, as shown in FIG. 8, a first section 22-1, a second section 22-2, a third section 22-3, and a fourth section 22-4, respectively. Similarly, symmetrically, the first tail is formed into four sections after four times of bending, that is, the first section of the first wire tail and the first section of the second wire tail are symmetrically attached to the wire-hanging part and the chamfered surface on two sides of the first boss; the second section of the first wire tail and the second section of the second wire tail are symmetrically attached to the bottom surface of the flange, parallel to each other; the third section of the first wire tail and the third section of the second wire tail are symmetrically attached to the wire-hanging part and the chamfered surface on two sides of the second boss; the fourth section of the first wire tail and the fourth section of the second wire tail are symmetrically attached to the top surface of the flange near the second side, parallel to each other.

In some preferred embodiments, the method further includes the step of cutting the first wire tail and the second wire tail, so that ends of the wire tails (i.e., the fourth sections of the two wire tails) buckled on the top surface of the flange after the fourth bending keeps a safe distance from and avoids interference with the wire wrap, wherein the cutting may be performed before the first bending, after the first bending, after the second bending or after the third bending. Cutting is not always necessary, and it is only necessary to cut the wire tail in the case that interference with the wire wrap is possible after the fourth bending.

In some preferred embodiments, each bending angle in steps (1) and (2) is 80-90°, more preferably, each bending angle is 90°. For example, the first bending is vertically downwards, the second bending is horizontally rightwards, the third bending is vertically upwards, and the fourth bending is horizontally leftwards as viewed in the orientations in FIGS. 3 to 8.

In some preferred embodiments, the method further includes the step of metallizing or pre-metallizing portions of the first wire tail and the second wire tail on the bottom surface of the flange (i.e., the second sections of the two wire tails) as electrodes of the inductor, respectively, after the winding structure is manufactured.

Figure 10:
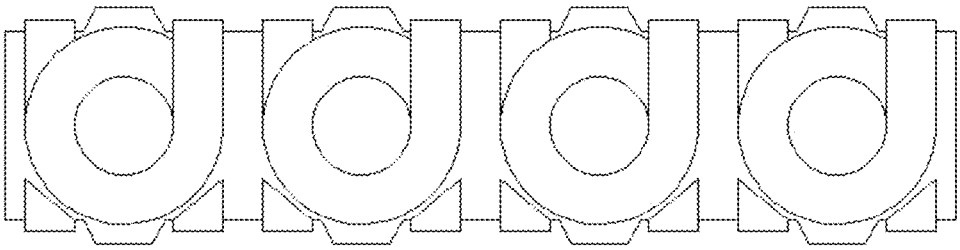
FIG. 10 is a schematic view showing a row of the winding structure according to an embodiment of this application.

According to the method of the embodiment of the application, a single winding structure can be formed, as shown in FIG. 9, or a row of the winding structures can also be formed by arranging the single winding structures according to a preset configuration, as shown in FIG. 10. The row of the winding structures is formed either by manufacturing single winding structures separately and then arranging or by arranging before winding and then manufacturing the winding structures simultaneously or sequentially.

The embodiments of this application also provide a winding inductor having the winding structure, the inductor can be a single inductor or a row of winding inductors formed by arranging the single inductors according to a predetermined configuration.

The application further provides a method for manufacturing the winding inductor, whereby the winding structure manufactured by the method for manufacturing the winding structure is formed into the winding inductor, and the forming methods can include cold pressing, hot pressing, glue filling, transfer moulding and the like.

A comparison between the winding structure obtained by the method of this application and the conventional winding structure (with the flange of the magnetic core not provided with chamfered surfaces and the wire tails not subjected to the four times of bending treatment as compared) is shown in Table 1 below.

TABLE 1

Comparison of the gap (mm) between the second section of the wire tail and the bottom surface of the flange

| Product Serial Number | Conventional Winding Structure | Winding Structure Herein |
|---|---|---|
| 1 | 0.087 | 0.050 |
| 2 | 0.074 | 0.050 |
| 3 | 0.081 | 0.056 |
| 4 | 0.087 | 0.043 |
| 5 | 0.068 | 0.062 |
| 6 | 0.081 | 0.062 |
| 7 | 0.130 | 0.068 |
| 8 | 0.081 | 0.043 |
| 9 | 0.112 | 0.043 |
| 10 | 0.093 | 0.043 |
| 11 | 0.093 | 0.031 |
| 12 | 0.111 | 0.043 |
| 13 | 0.081 | 0.068 |
| 14 | 0.099 | 0.050 |
| 15 | 0.031 | 0.050 |
| 16 | 0.124 | 0.043 |
| 17 | 0.105 | 0.043 |
| 18 | 0.099 | 0.037 |
| 19 | 0.105 | 0.050 |
| 20 | 0.074 | 0.037 |
| 21 | 0.074 | 0.043 |
| 22 | 0.081 | 0.031 |
| 23 | 0.068 | 0.037 |
| 24 | 0.074 | 0.037 |

TABLE 1-continued

| Comparison of the gap (mm) between the second section of the wire tail and the bottom surface of the flange | | |
|---|---|---|
| Product Serial Number | Conventional Winding Structure | Winding Structure Herein |
| 25 | 0.068 | 0.031 |
| 26 | 0.087 | 0.032 |
| 27 | 0.068 | 0.043 |
| 28 | 0.062 | 0.043 |
| 29 | 0.081 | 0.043 |
| 30 | 0.074 | 0.043 |
| 31 | 0.068 | 0.043 |
| 32 | 0.056 | 0.043 |
| Minimum | 0.130 | 0.068 |
| Maximum | 0.031 | 0.031 |
| Average | 0.084 | 0.045 |

A comparison between the winding inductor obtained by the method of this application and the conventional winding inductor (with the flange of the magnetic core not provided with chamfered surfaces and the wire tails not subjected to the four times of bending treatment as compared) is shown in Table 2 below.

TABLE 2

| Comparison of inductance (μH) | | |
|---|---|---|
| Product Serial Number | Conventional Winding Inductor | Winding Inductor Herein |
| 1 | 1.39 | 1.481 |
| 2 | 1.48 | 1.454 |
| 3 | 1.35 | 1.502 |
| 4 | 1.406 | 1.456 |
| 5 | 1.425 | 1.463 |
| 6 | 1.427 | 1.453 |
| 7 | 1.438 | 1.473 |
| 8 | 1.467 | 1.511 |
| 9 | 1.451 | 1.435 |
| 10 | 1.458 | 1.476 |
| 11 | 1.45 | 1.464 |
| 12 | 1.445 | 1.476 |
| 13 | 1.413 | 1.417 |
| 14 | 1.422 | 1.487 |
| 15 | 1.465 | 1.459 |
| 16 | 1.382 | 1.457 |
| 17 | 1.473 | 1.465 |
| 18 | 1.406 | 1.434 |
| 19 | 1.465 | 1.475 |
| 20 | 1.406 | 1.484 |
| 21 | 1.391 | 1.467 |
| 22 | 1.354 | 1.460 |
| 23 | 1.391 | 1.473 |
| 24 | 1.42 | 1.508 |
| 25 | 1.344 | 1.462 |
| 26 | 1.414 | 1.459 |
| 27 | 1.395 | 1.492 |
| 28 | 1.43 | 1.486 |
| 29 | 1.438 | 1.458 |
| 30 | 1.439 | 1.452 |
| 31 | 1.461 | 1.474 |
| 32 | 1.327 | 1.422 |
| Minimum | 1.327 | 1.511 |
| Maximum | 1.480 | 1.417 |
| Average | 1.419 | 1.467 |

As can be seen from Table 2, taking the inductance specification of 1.5±20% pH as an example, the process capability index Cpk of the inductance of the conventional winding inductor is 1.84, whereas the process capability index Cpk of the inductance of the winding inductor herein is 4.03, which shows that the process capability of this application is more stable, whereby a winding inductor with higher electrical accuracy and better consistency can be obtained. Therefore, compared with the conventional winding structure, the winding structure herein is higher in structural stability, which ensures higher electrical property and dimensional consistency of the inductor manufactured thereby, avoiding the risk of open circuit and short circuit.

The foregoing is a further detailed description of the application in connection with specific preferred embodiments, and is not to be taken as limiting the application to the specific embodiments described. It will be apparent to those skilled in the art that various equivalents and modifications featuring the same performance and use as herein can be made without departing from the spirit this application, and that such equivalents and modifications shall be covered by the scope of this application.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A winding structure for an inductor, comprising:

a magnetic core and a coil;

wherein the magnetic core comprises a center column, a flange, a first wire-hanging part, a second wire-hanging part, a third wire-hanging part, a fourth wire-hanging part, a first boss and a second boss, wherein the center column is connected at a top surface of the flange and extends upwards, the first boss is disposed in the middle of a first side of the flange and extends outwards, the second boss is disposed in the middle of a second side of the flange and extends outwards, and the first side is opposite the second side; two side surfaces of the first side of the flange on two sides of the first boss are used as the first wire-hanging part and the second wire-hanging part, respectively, and two side surfaces of the second side of the flange on two sides of the second boss are used as the third wire-hanging part and the fourth wire-hanging part, respectively;

a transition surface of the first wire-hanging part to a bottom surface of the flange is a first chamfered surface, a transition surface of the second wire-hanging part to a bottom surface of the flange is a second chamfered surface, a transition surface of the third wire-hanging part to a bottom surface of the flange is a third chamfered surface, and a transition surface of the fourth wire-hanging part to a bottom surface of the flange is a fourth chamfered surface;

the coil comprises a wire wrap, a first wire tail and a second wire tail extending from two ends of the wire wrap, respectively, and the wire wrap is sleeved on the center column;

a first section of the first wire tail is attached to the first wire-hanging part and the first chamfered surface, a second section of the first wire tail is attached to the bottom surface of the flange, a third section of the first wire tail is attached to the third wire-hanging part and the third chamfered surface, and a fourth section of the first wire tail is buckled to the top surface of the flange; a first section of the second wire tail is attached to the second wire-hanging part and the second chamfered surface, a second section of the second wire tail is attached to the bottom surface of the flange, a third section of the second wire tail is attached to the fourth wire-hanging part and the fourth chamfered surface, and a fourth section of the second wire tail is buckled to the top surface of the flange; the second section of the first wire tail and the second section of the second wire tail are parallel.

2. The winding structure according to claim 1, wherein each of the first wire-hanging part, the second wire-hanging part, the third wire-hanging part and the fourth wire-hanging part is a vertical plane, each of the first chamfered surface, the second chamfered surface, the third chamfered surface and the fourth chamfered surface is an inclined plane, the vertical plane and the inclined plane form a convex V-shape, the vertical plane is perpendicular to the top surface of the flange, and the inclined plane is inclined from a bottom edge of the vertical plane to the bottom surface of the flange; preferably, an angle of inclination of the inclined plane is between 30° and 45°.

3. The winding structure according to claim 1, wherein each of a gap between the second section of the first tail and the bottom surface of the flange and a gap between the second section of the second tail and the bottom surface of the flange is 0-0.1 mm; the wire tails have a wire thickness such that the wire tails attached to the wire-hanging parts do not reach beyond outer edges of the first boss and the second boss; a length of each wire-hanging part is greater than a width of each of the two wire tails and a length of each chamfered surface is greater than the width of each of the two wire tails.

4. The winding structure according to claim 1, wherein the magnetic core is an integrally formed structure.

5. A winding inductor having the winding structure according to claim 1.

6. A method for manufacturing the winding structure according to claim 1, comprising the steps of:

(1) compressing the wire wrap sleeved on the center column;

(2) starting from the top surface of the flange, bending the first wire tail downwards for the first time to enable the first section of the first wire tail to be attached to the first wire-hanging part and the first chamfered surface, bending the first wire tail rightwards for the second time to enable the second section of the first wire tail to be attached to the bottom surface of the flange, and then bending the first wire tail upwards for the third time to enable the third section of the first wire tail to be attached to the third wire-hanging part and the third chamfered surface, finally, bending leftwards for the fourth time to enable the fourth section of the first wire tail to be buckled on the top surface of the flange;

(3) starting from the top surface of the flange, bending the second tail downwards for the first time to enable the first section of the second tail to be attached to the second wire-hanging part and the second chamfered surface, bending the second tail rightwards for the second time to enable the second section of the second tail to be attached to the bottom surface of the flange, and then bending upwards for the third time to enable the third section of the second tail to be attached to the fourth wire-hanging part and the fourth chamfered surface, finally, bending leftwards for the fourth time to enable the fourth section of the second tail to be buckled on the top surface of the flange.

7. The method according to claim 6, further comprising the step of cutting the first wire tail and the second wire tail, so that each of the fourth sections of the two wire tails buckled on the top surface of the flange after the fourth bending keeps a safe distance from and avoids interference with the wire wrap, wherein the cutting is performed before the first bending, after the first bending, after the second bending or after the third bending.

8. The method according to claim 6, wherein each bending angle in steps (1) and (2) is 80° to 90°.

9. The method according to claim 6, further comprising the step of metallizing or pre-metallizing portions of the first wire tail and the second wire tail on the bottom surface of the flange, respectively.

10. A method for manufacturing a winding inductor, wherein the winding structure manufactured by the method for manufacturing the winding structure as claimed in claim 6 is formed into the winding inductor.

* * * * *